US011933149B2

(12) United States Patent
Beary et al.

(10) Patent No.: US 11,933,149 B2
(45) Date of Patent: Mar. 19, 2024

(54) FLUID FLOW CONTROL IN A HYDROCARBON RECOVERY OPERATION

(71) Applicant: Cenovus Energy Inc., Calgary (CA)

(72) Inventors: Kevin Beary, Calgary (CA); Jessica Girling, Calgary (CA); Jason Griffiths, Calgary (CA); Michael N. Holmes, Calgary (CA); Mike Miller, Calgary (CA); Joel Schmitz, Calgary (CA); Lazar Velev, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 17/992,877

(22) Filed: Nov. 22, 2022

(65) Prior Publication Data

US 2023/0093424 A1 Mar. 23, 2023

Related U.S. Application Data

(62) Division of application No. 17/350,522, filed on Jun. 17, 2021.

(60) Provisional application No. 63/040,820, filed on Jun. 18, 2020.

(51) Int. Cl.

| | |
|---|---|
| ***E21B 43/12*** | (2006.01) |
| ***E21B 43/24*** | (2006.01) |
| ***E21B 49/08*** | (2006.01) |

(52) U.S. Cl.

CPC ..... *E21B 43/12* (2013.01); *E21B 43/24* (2013.01); *E21B 49/0875* (2020.05)

(58) Field of Classification Search

CPC .... E21B 43/24; E21B 43/2408; E21B 43/305; E21B 43/2406; E21B 43/12; E21B 43/16; E21B 43/243

See application file for complete search history.

(56) References Cited

FOREIGN PATENT DOCUMENTS

| | | | | | |
|---|---|---|---|---|---|
| CA | 2618181 | C | * | 3/2011 | ..... E21B 36/00 |
| CA | 2618181 | C | | 3/2011 | |
| CA | 2483371 | C | | 2/2013 | |
| CA | 3020827 | C | | 1/2020 | |
| CN | 106547973 | B | | 12/2019 | |

OTHER PUBLICATIONS

Becerra et al., "Liner-Deployed Inflow Control Devices ICD Production Results in Mackay River SAGD Wells," Society of Petroleum Engineers Canada Heavy Oil Technical Conference, Mar. 2018, 12 pages.

(Continued)

*Primary Examiner* — Zakiya W Bates

(74) *Attorney, Agent, or Firm* — Gordon & Jacobson, P.C.

(57) ABSTRACT

A method of completing an injection well includes determining a volume of recoverable oil in each of a plurality of intervals along the injection well in a reservoir, and determining a target steam flow for respective ones of the intervals to facilitate recovery of the recoverable oil from the intervals. A quantity of steam outlets in devices along the injection well is determined for delivery of the target volume of steam determined for the ones of the intervals. The injection well is completed including steam injection tubing having the determined number of steam outlets for delivery of the target volume of steam to the ones of the intervals.

8 Claims, 9 Drawing Sheets

(56) References Cited

OTHER PUBLICATIONS

Lastiwka et al., "A Practical Approach to the Use and Design of Flow Control Devices in SAGD," Society of Petroleum Engineers Canada Heavy Oil Technical Conference, Feb. 2017, 13 pages.
Least et al., "Steam Flow Tests for Comparing Performance of Nozzle, Tube, and Fluidic Diode Autonomous ICDs in SAGD Wells," Society of Petroleum Engineers Canada Heavy Oil Conference, Jun. 2014, 12 pages.
Li et al., "A New ICD/ICV Well Completion Design Optimizer and Well Management Logic for Full Field Reservoir Simulation With Multiple ICD/ICV Wells," Abu Dhabi International Petroleum Exhibition and Conference, Nov. 2017, 17 pages.
Miersma et al., "Evaluation of Inflow Control Device Performance Using Computational Fluid Dynamics," Society of Petroleum Engineers Canada Heavy Oil Technical Conference, Mar. 2018, 15 pages.
Park et al., "Flow Control Devices for SAGD Applications: Lessons Learned, Best Practices, and Suggested Design Improvements," Society of Petroleum Engineers Thermal Well Integrity and Design Symposium, Nov. 2017, 14 pages.
Rahimbakhsh et al., "Investigating the Effect of Employing Inflow Control Devices on the Injection Well on the SAGD Process Efficiency Using an Integrated Production Modeling ," Society of Petroleum Engineers EOR Conference at Oil and Gas West Asia, Mar. 2018, 13 pages.
Santos et al., "An Overview of Heavy Oil Properties and its Recovery and Transportation Methods," Brazilian Journal of Chemical Engineering , Jul.-Sep. 2014, vol. 31 (3), pp. 571-590.
U.S. Appl. No. 17/350,522, filed Jun. 17, 2021; Cenovus Energy Inc.
U.S. Appl. No. 17/993,524, filed Nov. 23, 2022; Cenovus Energy Inc.

* cited by examiner

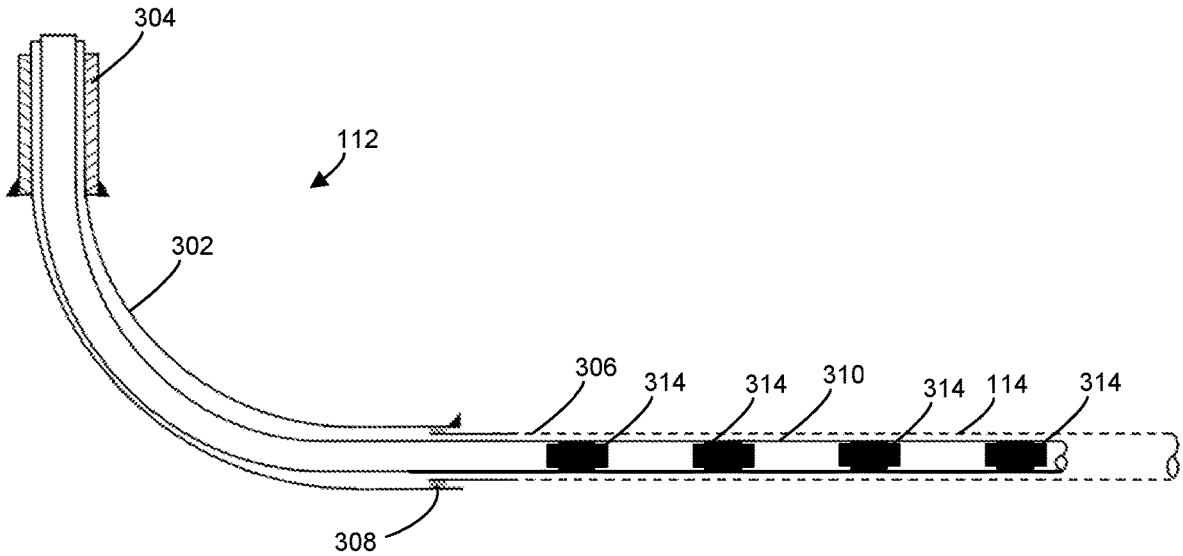
FIG. 3
FIG. 4A
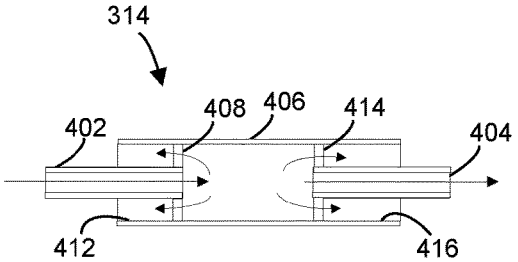
FIG. 4B
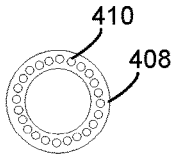

FLUID FLOW CONTROL IN A HYDROCARBON RECOVERY OPERATION

This application is a divisional of U.S. application Ser. No. 17/350,522, filed on Jun. 17, 2021, which claims benefit of U.S. Provisional Patent Application No. 63/040,820, filed on Jun. 18, 2020, the contents of which are hereby incorporated herein by reference in their entireties.

TECHNICAL FIELD

The present disclosure relates to the injection of fluids including steam into a subterranean reservoir bearing heavy oil or bitumen.

BACKGROUND

Extensive deposits of hydrocarbons exist around the world. Reservoirs of such deposits may be referred to as reservoirs of light oil, medium oil, heavy oil, extra-heavy oil, bitumen, or oil sands, and include large oil deposits in Alberta, Canada. It is common practice to segregate petroleum substances into categories that may be based on oil characteristics, for example, viscosity, density, American Petroleum Institute gravity (°API), or a combination thereof. For example, light oil may be defined as having an °API≥31, medium oil as having an °API≥22 and <31, heavy oil as having an °API≥10 and <22 and extra-heavy oil as having an °API≤10 (see Santos, R. G., et al. Braz. *J. Chem. Eng*. Vol. 31, No. 03, pp. 571-590). Although these terms are in common use, references to different types of oil represent categories of convenience, and there is a continuum of properties between light oil, medium oil, heavy oil, extra heavy oil, and bitumen. Accordingly, references to such types of oil herein include the continuum of such substances, and do not imply the existence of some fixed and universally recognized boundary between the substances.

One thermal method of recovering viscous hydrocarbons in the form of bitumen, also referred to as oil sands, is known as steam-assisted gravity drainage (SAGD). In the SAGD process, pressurized steam is delivered through an upper, horizontal, injection well, also referred to as an injector, into a viscous hydrocarbon reservoir while hydrocarbons are produced from a lower, generally parallel, horizontal, production well, also referred to as a producer, that is near the injection well and is vertically spaced from the injection well. The injection and production wells are situated in the lower portion of the reservoir, with the producer located close to the base of the hydrocarbon reservoir to collect the hydrocarbons that flow toward the base of the reservoir.

The injected steam during SAGD initially mobilizes the hydrocarbons to create a steam chamber in the reservoir around and above the horizontal injection well. The term steam chamber in the context of a SAGD operation is utilized to refer to the volume of the reservoir that is heated to the steam saturation temperature with injected steam and from which mobilized oil has at least partially drained and been replaced with steam vapor. As the steam chamber expands, viscous hydrocarbons in the reservoir and water originally present in the reservoir are heated and mobilized and move with aqueous condensate, under the effect of gravity, toward the bottom of the steam chamber. The hydrocarbons, the water originally present, and the aqueous condensate are typically referred to collectively as emulsion. The emulsion accumulates and is collected and produced from the production well. The produced emulsion is separated into dry oil for sales and produced water.

Due to differences in viscosity between the displacing fluid and the oil, as well as the heterogeneous nature of most reservoirs, heating of the viscous hydrocarbons and displacement of hydrocarbons is non-uniform along the length of the injection or production wells. The control of the displacing fluid distribution along the length of the injection well is therefore desirable. Fluid control and distribution devices may be utilized along the length of the injection well.

Improvements in control of fluid flow in wells utilized in hydrocarbon recovery are desirable.

SUMMARY

According to one aspect, a method of completing an injection well includes determining a volume of recoverable oil in each of a plurality of intervals along the injection well in a reservoir, and determining a target steam flow for respective ones of the intervals to facilitate recovery of the recoverable oil from the intervals. A quantity of steam outlets in devices along the injection well is determined for delivery of the target volume of steam determined for the ones of the intervals. The injection well is completed including steam injection tubing having the determined number of steam outlets for delivery of the target volume of steam to the ones of the intervals.

Determining the volume of recoverable oil may comprise determining three-dimensional geological properties of the intervals along the length of the injection well.

Determining the three-dimensional geological properties may comprise determining permeability and oil saturation.

The intervals may comprise three-dimensional sections of the reservoir divided in regular intervals along the length of the injection well.

Determining a number of steam outlets may comprise determining a number of steam outlets of each of a plurality of steam splitters, each of the steam splitters associated with at least one of the intervals along the injection well.

The number of steam outlets of each of the steam splitters may be determined based on respective locations of the steam splitters along the length of the injection well, and the target steam flow for the respective ones of the intervals.

The number of steam outlets of each may be determined utilizing hydraulic pipe flow calculations to direct the target steam flow to the respective ones of the intervals.

A number of steam outlets varies amongst the steam splitters based on target steam flow and location of each of the steam splitters.

The steam splitters may comprise shiftable steam splitters for controlling the flow of steam into each of the three-dimensional sections of the reservoir.

The method may include performing a simulation of a recovery operation in the reservoir utilizing the three-dimensional geological properties of the intervals along the length of the injection well and utilizing the determined number of steam outlets to confirm hydrocarbon recovery results prior to completing.

According to an aspect of an embodiment, an injection well in a hydrocarbon reservoir comprises steam injection tubing having steam splitters spaced apart along the length of the tubing, each of the steam splitters having steam outlets for directing steam into the hydrocarbon reservoir, wherein a quantity of steam outlets varies amongst the steam splitters based on a target flow of steam and location of each of the steam splitters along the length of the hydrocarbon reservoir, wherein the target flow of steam is determined based on hydrocarbon reservoir properties in sections of the reservoir, the sections of the reservoir each associated with at least one of the steam splitters.

The sections of the reservoir may comprise three-dimensional sections divided in regular intervals.

Each three-dimensional section may be associated with one or two steam splitters.

The hydrocarbon reservoir properties may comprise a volume of recoverable oil in each of the three-dimensional sections.

The hydrocarbon reservoir properties may comprise a permeability of each of the three-dimensional sections.

The steam splitters may comprise shiftable steam splitters for controlling the flow of steam into each of the three-dimensional sections.

According to another aspect, a method is provided for controlling steam injected via an injection well into a hydrocarbon reservoir. The method includes measuring temperatures at a plurality of locations along a portion of a production well extending generally horizontally along the hydrocarbon reservoir, and controlling flow control devices disposed along the injection well to control the steam injected into the reservoir in response to the temperatures measured at the plurality of locations.

Controlling the flow control devices may comprise opening or closing one or more of the flow control devices to control the steam injected.

The temperatures may be measured utilizing a distributed temperature sensing system disposed along the production well.

The flow control devices may be controlled by opening or closing one or more of the flow control devices in response to detecting one or both of a cold spot and a hot spot utilizing the temperatures measured at the locations along the portion of the production well extending generally horizontally along the hydrocarbon reservoir.

The flow control devices may comprise shiftable steam splitters and controlling comprises controlling each one of the flow controlling devices separately such that at least a one of the shiftable steam splitters is open and at least another of the shiftable steam splitters is closed during a period of injecting steam.

The method may also include injecting steam via the injection well and producing fluids via the production well.

The method may include continuing to monitor temperatures at the plurality of locations along the portion of the production well during production of the fluids.

BRIEF DESCRIPTION OF THE DRAWINGS

Embodiments of the present invention will be described, by way of example, with reference to the drawings and to the following description, in which:

FIG. 3 is a side view of a completed injection well;

FIG. 4A is a sectional side view of an example of a steam splitter of the injection well of FIG. 3;

FIG. 4B is an end view of a collar of the steam splitter of FIG. 4A;

DETAILED DESCRIPTION

Figure 1:
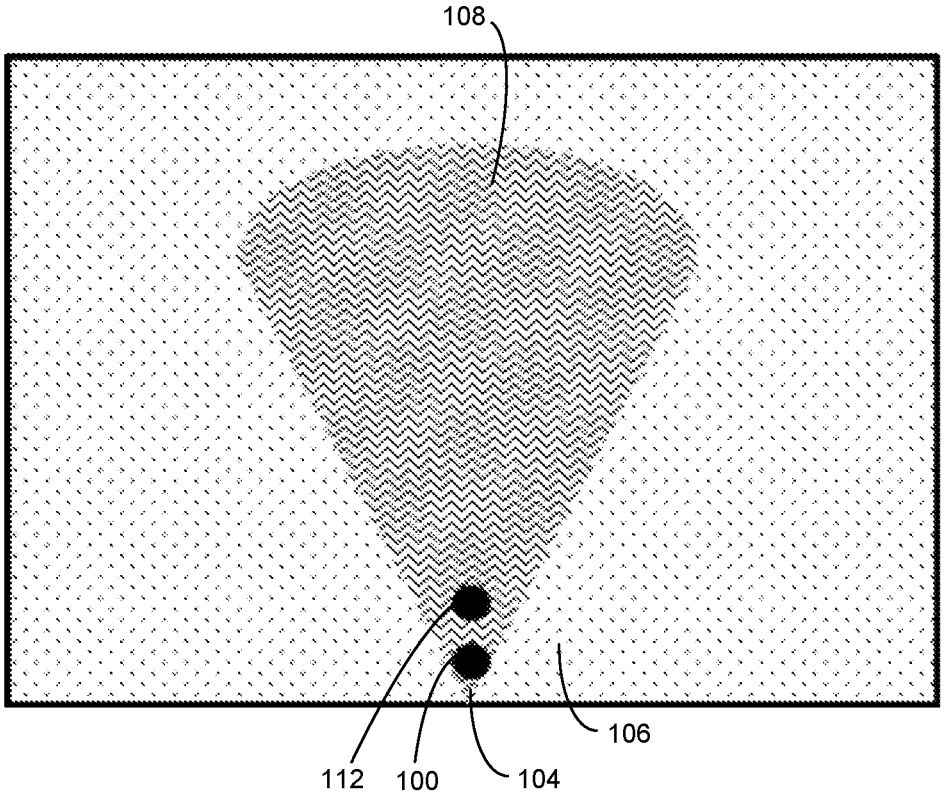
FIG. 1 is a schematic sectional view of a reservoir and shows the relative location of an injection well and a production well.

The present application is directed to the injection of steam via an injection well. According to one aspect, a method of completing an injection well includes determining a volume of recoverable oil in each of a plurality of intervals along the injection well in a reservoir, and determining a target steam flow for respective ones of the intervals to facilitate recovery of the recoverable oil from the intervals. A quantity of steam outlets in outflow control devices along the injection well is determined for delivery of the target volume of steam determined for the ones of the intervals. The injection well is completed including steam injection tubing having the determined number of steam outlets for delivery of the target volume of steam to the ones of the intervals.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Figure 2:
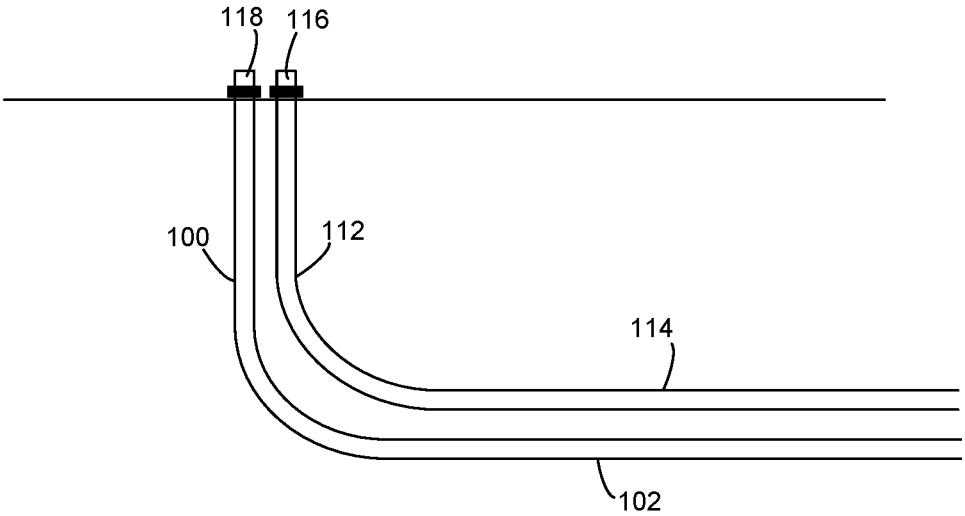
FIG. 2 is a sectional side view of a well pair including an injection well and a production well.

An example of a well pair is illustrated in FIG. 1 and FIG. 2. The hydrocarbon production well 100 includes a generally horizontal portion 102 that extends near the base or bottom 104 of the hydrocarbon reservoir 106. An injection well 112 also includes a generally horizontal portion 114 that is disposed generally parallel to and is spaced vertically above the horizontal portion 102 of the hydrocarbon production well 100.

During production utilizing SAGD, steam is injected into the injection well head 116 and through the steam injection well 112 to mobilize the hydrocarbons and create a steam chamber 108 in the reservoir 106, around and above the generally horizontal portion 114.

Viscous hydrocarbons in the reservoir 106 are heated and mobilized and the mobilized hydrocarbons drain under the effects of gravity. Fluids, including the mobilized hydrocarbons along with condensate, are collected in the generally horizontal portion 102 and are recovered via the hydrocarbon production well 100. Production may be carried out for any suitable period of time.

Referring to FIG. 3, an injection well 112 is illustrated, including injection flow control devices (also known as outflow control devices). The injection well 112 includes a casing 302 that extends generally vertically along the injection well 112, through a surface casing 304 to a liner 306, which may be a screen or slotted liner, for example. The casing 302 is coupled to the liner 306 utilizing a liner hanger 308.

Injection tubing 310 is coupled to steam generators at the surface, such as a Once Through Steam Generator (OTSG) and extends through the wellbore of the injection well 112 to steam outlets of outflow control devices such as steam splitters 314. The steam splitters 314 are spaced apart along the generally horizontal portion of the injection well, such that the steam splitters 314 are located at intervals along the horizontal portion of the injection well 112.

An example of a steam splitter is shown in FIG. 4A. Each steam splitter 314 includes an inlet tube 402, and an outlet tube 404 coupled together by a body 406 through which the steam flows. The inlet tube 402, the outlet tube 404, and the body 406 are generally concentric. The inlet tube 402 extends into the body 406 and is coupled to the body by a first collar 408 disposed between the inlet tube 402 and the body 406. The first collar 408 is shown in FIG. 4B and includes steam outlets 410, which are holes that extend through the first collar for the flow of steam out of the body 406 and into the reservoir. The body 406 extends over the first collar 408 to provide a first shroud 412 to protect the collar 408 and maintain a path for the flow of steam into the reservoir. The outlet tube 404 extends from a position within the body 406, to an outside and is coupled to the body 406 by a second collar 414, which is similar to the first collar 408. The body 406 extends over the second collar 414 to provide a second shroud 416.

The steam splitter 314 is coupled along injection tubing with the injection tubing coupled to the inlet tube 402 to provide steam to the steam splitter 412 and coupled to the outlet tube 404 to receive steam that passes through the steam splitter 314 and continues along the horizontal portion of the injection well 112. While some of the steam that enters the inlet tube 402 continues along the body 406 and out the outlet tube 404, a fraction of the steam exits the body 406 via the steam outlets 410 through the collars 408, 414. The flow of steam through the steam splitter 314 is generally indicated by the arrows shown in FIG. 4A.

Figure 5:
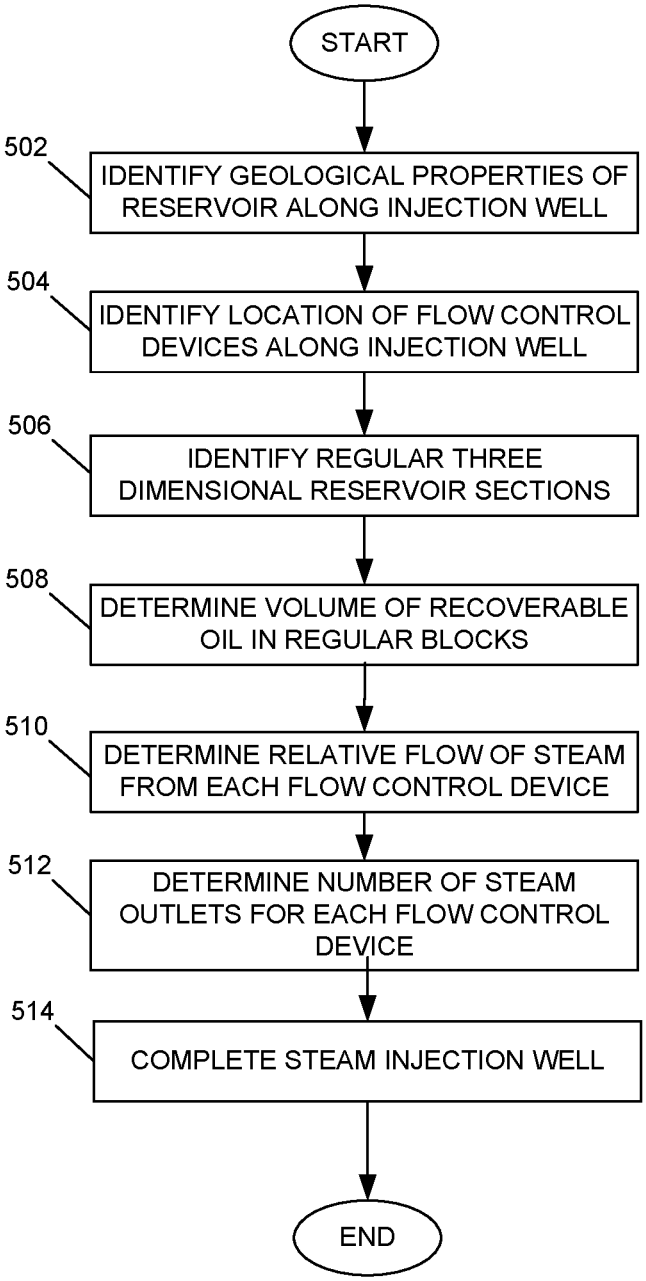
FIG. 5 is a flowchart showing a method of completing an injection well for use in a hydrocarbon recovery operation.

A flowchart illustrating a method of completing an injection well 112 for use in a hydrocarbon recovery operation in accordance with one embodiment is shown in FIG. 5. The method may include additional or fewer elements than shown and described and parts of the method may be performed in a different order than shown or described herein. The method may begin prior to drilling an injection well 112, or may begin after drilling is started or even completed. Parts of the method may be carried out utilizing software.

The geological properties of the reservoir 106 along the length injection well 112 are determined at 502. The geological properties are determined in all three dimensions, length, width, and depth, and include determining porosity, permeability of the reservoir 106, oil saturation, and pay thickness or thickness of the oil-rich zones within the reservoir 106. The properties are determined along the length of the injection well 112 to provide reservoir 106 properties along the length of the injection well 112.

The location of steam flow control devices, which may be steam splitters 314 as described with reference to FIG. 4, are determined at 504. The steam splitters 314 are located at regular intervals along the length of the horizontal portion of the injection well 112 to facilitate the injection of steam at regular intervals along the injection well 112. With the steam splitters 314 located at regular intervals and spaced apart by a known distance, the locations of the steam splitters within the reservoir is identifiable. Alternatively, the steam splitters 314 may be located at irregular intervals along the length of the horizontal portion of the injection well 112.

The reservoir 106 is divided into three dimensional sections along the length of the injection well 112 at 506. These three-dimensional sections of the reservoir 106, along the injection well 112 may be, for example, regular 50 meter sections along the length. Alternatively, the three-dimensional sections may be irregular in length along the length of the injection well.

The volume of recoverable oil in each of the three-dimensional sections along the length of the injection well 112 is determined at 508 based on the dimensions of each of the three-dimensional sections and the geological properties of that particular section in the reservoir 106.

A target flow of steam from each of the steam splitters 314 is determined at 510. The target flow of steam from each steam splitter 314 is determined based on the volume of recoverable oil in each of the three-dimensional sections, as determined at 508, and a relative amount of steam to be delivered for each of the steam splitters 314, referred to as accountability. The accountability is a percentage of the target flow of steam contributed by a steam splitter 314 to that three-dimensional section. Depending on the location of the three-dimensional section relative to the steam splitters 314, and the geological properties, a single steam splitter 314 may be accountable for 100% of the steam to be delivered to that three-dimensional section or two steam splitters 314 that are adjacent but spaced apart, may each contribute a percentage of the steam to be delivered to that three-dimensional section. For example, a section that is located between two spaced apart, adjacent steam splitters 314, may receive steam from both of the two spaced apart adjacent steam splitters 314. Thus, based on the geological characteristics and the location of the section, the percentage of the target steam for that section that each steam splitter 314 contributes, is calculated. Utilizing the accountability, the relative steam flow from each of the steam splitters 314 is determined, for example, by summing the steam accountability multiplied by the total producible oil in place for each steam splitter.

Based on pressure and based on the steam flow rate to be delivered from each steam splitter 314, a number of steam outlets for each steam splitter is determined at 512.

The number of steam outlets are calculated utilizing hydraulic equations based on the target flow through each steam splitter 314 and the respective position of each steam splitter 314. One example of the determination of the number of steam outlets is described below, including specific reference to particular equations. Other equations or simplified calculations may be utilized.

Figure 6:
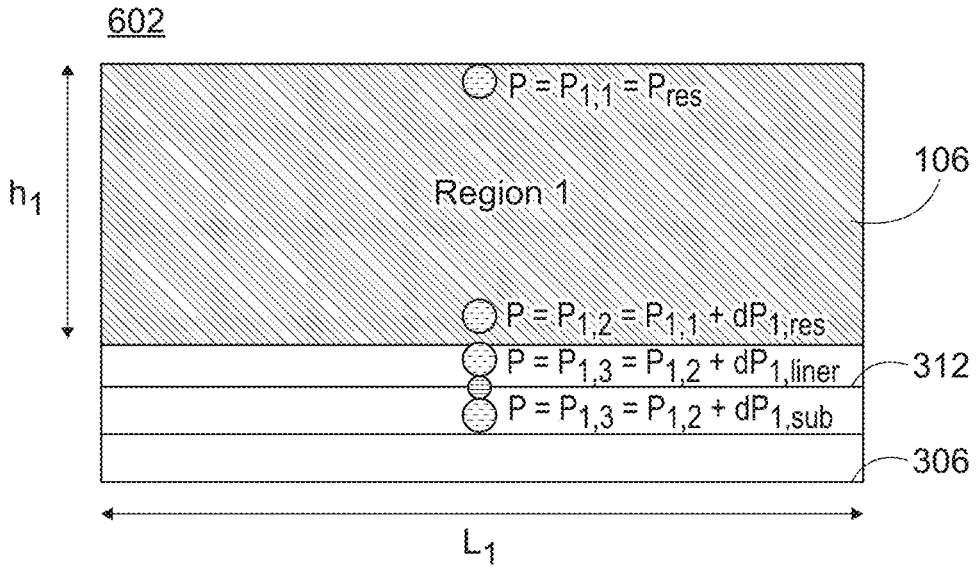
FIG. 6 is a schematic representation of a section of a reservoir, including a steam splitter.

The reservoir 106 is divided into sections with a single steam splitter 314 in each section. Thus, the length of each section is dependent on the positions of the steam splitters 314 along the horizontal portion 114 of the injection well 112. It is assumed that the first section begins at 0 meters and the last section ends at the end of the injection well 112. Each section is divided from the adjacent section at the halfway point between the steam splitters 314. One example of a section is illustrated in FIG. 6, showing the liner 306 and injection tubing 312 in the section 602 of the reservoir 106.

The pressure at the top of the oil in the section that is penetrable by the steam and from which drainage may occur, referred to as the rich pay, is assumed to be constant along the length of the injection well 112. Utilizing Darcy's equation for flow through porous media, a reservoir pressure drop is calculated and the pressure outside the liner of the injection well 112 in each section is calculated:

$$P_{i,2} = P_{res} + dP_{i,res} = P_{res} + dpResMult * \frac{\dot{m}_i \mu h_i}{k_{rg} k_i L_i w \rho}$$

Where:

$P_{res}$ is the reservoir pressure;

dpResMult is the multiplier applied to the reservoir pressure drop (either 1 or 0);

$\dot{m}_i$ is mass flowrate through section i (determined by target steam through each steam splitter);

μ is steam viscosity;

$h_i$ is height of section i;

$k_{rg}$ is relative permeability to gas at residual oil and water;

$k_i$ is absolute vertical permeability of section i;

$L_i$ is length of section i;

w is reservoir width, assumed to be half of well spacing (average width when steam chamber reaches top of pay if steam chamber is a triangle); and ρ is steam density.

The variable dpResMult is an optional toggle that may be utilized to determine whether the calculation takes a pressure drop in the reservoir into account. Thus, the pressure drop may be taken into account by setting dpResMult to 1. If dpResMult=0, the pressure node is moved to the outside of the liner, i.e., $P_{i,2}=P_{res}$. The pressure node is a point that is considered constant in all of the sections of the reservoir.

The pressure in the liner ($P_{i,3}$) is calculated using Darcy's equation for radial flow from a pipe with skin:

$$P_{i,3} = P_{i,2} + dP_{i,liner} = P_{i,2} + dpLinerMult * \frac{\dot{m}_i \mu (\ln(r_e / r_w) + S)}{2\pi L_i k_{rg} k_i \rho}$$

where:

dpLinerMult is the multiplier applied to the liner pressure drop (either 1 or 0)

$r_e$ is effective reservoir radius (boundary condition in derivation of redial wellbore flow)

$r_w$ is liner radius

S is injector skin

The effective reservoir radius $r_e$ is a reservoir parameter and the skin S is factor for a zone of reduced permeability.

If dpResMult=dpLinerMult=0, the pressure node is moved to the inside of the liner, i.e., $P_{i,3}=P_{res}$. dpLinerMult is an optional toggle that may be utilized to determine whether the calculation takes a pressure drop across the liner into account. Thus, the pressure drop may be taken into account by setting dpLinerMult to 1.

Starting with the assumption that pressure is constant at the top of the rich pay in each of the sections, the pressures elsewhere may be calculated utilizing this constant pressure and adding a pressure drop to get from a first point to a second point. The pressure outside the liner is therefore equal to the pressure at the top of the rich pay plus the pressure drop in the fluid when flowing through the reservoir. If dpResMult=0, the pressure drop is not taken into account, the pressure drop is effectively considered 0 and thus, the pressure outside the liner is equal in all sections. The pressure inside the liner is calculated as the pressure outside the liner plus the pressure drop in the fluid across the liner. If this pressure drop across the liner is also not taken into account (dpLinerMult=0), the pressure drop across the liner is effectively considered 0 and the pressure inside the liner is considered equal in all sections.

$$P_{liner}=P_{richtop}+dP_{resMult}\Delta P_{res}+dP_{linerMult}\Delta P_{liner}$$

When dpResMUlt and dpLinerMult are both 0, then $P_{liner}=P_{richtop}$

The pressures inside the tubing are determined from the toe toward the heel of the injection well. If the toe of the well is an open toe, the liner pressure is assumed to be equal to the tubing pressure at the toe. If the toe of the well is a closed toe, the number of outlets in the last steam splitter (closest to the toe) is assumed and the pressure drop across that steam splitter is calculated assuming incompressible flow, giving the pressure in the tubing at the toe:

$$\Delta P_{sub} = \frac{n_{outlets} \dot{m}_{sub}^2}{2 A_o^2 C_d^2 \rho}$$

where:

$n_{outlets}$ is number or outlets the steam splitter $A_o$ is the area of a single hole:

$$A_o = \frac{\pi}{4} d_o^2$$

$d_o$ is orifice diameter $C_d$ is orifice discharge coefficient

To determine the number of outlets in the remaining steam splitters, the tubing pressure profile is determined by calculating a frictional pressure drop based on the flowrate and distance between steam splitters and using the toe as a pressure node:

$$Re = \frac{4\dot{m}_{tubing}}{\pi \mu d_{tubing}}$$

$$f = \max\left(\frac{64}{Re} \cdot 0.0057\left(1 + \left(17300\frac{\epsilon}{d_{tubing}} + \frac{10^6}{Re}\right)^{1/3}\right)\right)$$

$$\Delta P_{tubing} = \frac{\rho f L_{tubing} v_{tubing}^2}{2 d_{tubing}}$$

Where:

Re is Reynolds number $\dot{m}_{tubing}$ is maw flowrate in the tubing (varies along the length of the well depending on how much steam has left at each steam splitter)

$d_{tubing}$ is diameter of the tubing f is Darcy friction factor

∈ is pipe roughness $\Delta P_{tubing}$ is pressure drop in the tubing between 2 steam splitters $L_{tubing}$ is tubing length between 1 steam splitters $v_{tubing}$ is flow velocity in tubing between 2 steam splitters (varies with $\dot{m}_{tubing}$)

The steam flow out of each steam splitter is known (i.e., the target steam from each steam splitter was determined), the tubing pressure profile is determined. The casing pressures ($P_{i,3}$) are known and assumed constant for each region. Thus, the pressure drop across the steam splitter is calculated as:

$$\Delta P_{sub}=P_{i,4}-P_{i,3}$$

The number of outlets in each steam splitter, to reach the steam flow (i.e., target steam) from each steam splitter, is determined by:

$$n_{outlets} = \frac{\dot{m}_{sub}}{eA_oC_d\sqrt{\frac{2\Delta P_{sub}\rho}{(1-\beta^4)}}}$$

$$e = 1 - (0.41 + 0.35\beta^4)\frac{\Delta P_{sub}}{\gamma P_{i,4}}$$

$$\beta = d_o / d_{tubing}$$

where:

e is gas expansion parameter

β is the ratio of orifice diameter to tubing inner diameter

γ is steam heat capacity ration $C_P/C_V$

The number of steam outlets in each steam splitter 314 is determined to control the volume of steam input into the reservoir 106 through that steam splitter 314. The number of steam outlets for each steam splitter 314 is therefore determined to facilitate delivery of the steam for recovery of the oil in place. The number of steam outlets of each of the steam splitters 314 is determined utilizing hydraulic pipe flow calculations to direct the target volume of steam to each of the sections.

Thus, the number of steam outlets of each of the steam splitters 314 is determined based on respective locations of the steam splitters 314 along the length of the injection well 112, and the target volume of steam for the sections.

Optionally, a size of each of the outlets may be determined and outlet size for one steam splitter may differ from the outlet sizes of a second steam splitter.

A simulation utilizing computer simulation software to simulate a recovery operation in the reservoir 106 may be performed. The three-dimensional geological properties of the intervals along the length of the injection well are utilized to simulate recovery from the same reservoir, utilizing the determined number of steam outlets in the steam splitters 314. The simulation may be utilized to confirm, based on the computer simulation, the expected recovery utilizing the customized completion including the determined number of steam outlets in each steam splitter 314 prior to completion.

The injection well 112 including the steam splitters 314 each with the determined number of steam outlets for delivery of the target steam flow to the ones of the intervals, is completed at 514.

An example of the method of FIG. 5 is described. As indicated above, geological properties of the reservoir 106 along the length injection well 112 are determined at 502. The geological properties are determined in all three dimensions, length, width, and depth, and include determining porosity, permeability, oil saturation, and pay thickness or thickness of the oil-rich zones within the reservoir 106. The properties may be determined utilizing geological characteristics from geological exploration and drilling profiles developed. The geological characteristics are based on surveillance data such as exploration or stratigraphic test wells drilled, and seismic data to develop a three-dimensional model.

Figure 7:
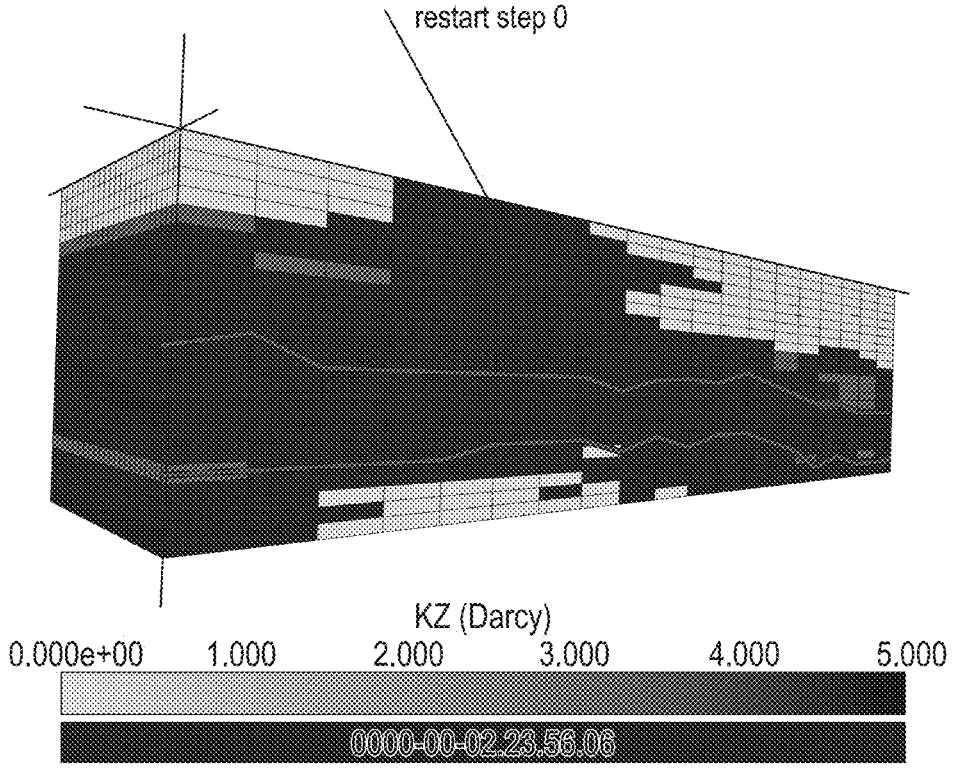
FIG. 7 shows a geo-model illustrating permeability profiles over vertical sections of the reservoir along a length of an injection well.

Referring to FIG. 7, a geo-model illustrating permeability profiles over vertical sections of the reservoir along a length of an injection well, in accordance with one example is shown. The model illustrates the variation in permeability within the reservoir and demonstrates geological properties of the regular three-dimensional reservoir sections.

The location of steam flow control devices is identified and the volume of recoverable oil, also referred to as producible oil, in each of the three-dimensional sections is determined. Utilizing the volume of producible oil in each of the three-dimensional sections, and the permeability, the target volume of steam to be delivered to each of the three-dimensional sections is determined.

The producible oil in place is determined for each of the sections utilizing, the size of the section, including length, width, and height, the porosity of the section, and the oil saturation. The height of the oil in the section that is penetrable by the steam, referred to as the rich pay, is utilized to determine the producible oil in place. The relative flow rate of steam to be delivered to each block is proportional to the producible oil in place that is determined.

Again, utilizing the locations of the steam splitters 314 within the reservoir, an accountability for each steam splitter is determined for each of the three-dimensional sections. The accountability is a percentage of steam contributed by a steam splitter to that three-dimensional section. Table 1 illustrates accountability of the steam splitters and the toe of the injection well for sections of a reservoir in accordance with one example.

TABLE 1

STEAM SPLITTER ACCOUNTABILITY

| | | | 1 | 2 | 3 | 4 | 5 | Toe |
|---|---|---|---|---|---|---|---|---|
| | | Position (m) | 77.27 | 231.82 | 386.36 | 540.91 | 695.45 | 850.00 |
| | | Lbound (m) | 0 | 154.55 | 309.09 | 463.64 | 618.18 | 772.73 |
| | | Ubound (m) | 154.55 | 309.09 | 463.64 | 618.18 | 772.73 | 850.00 |
| Block | LBound (m) | Ubound (m) | S1 Acc. | S2 Acc. | S3 Acc. | S4 Acc. | S5 Acc. | Toe Acc. |
| 1 | 0 | 50 | 100% | 0% | 0% | 0% | 0% | 0% |
| 2 | 50 | 100 | 100% | 0% | 0% | 0% | 0% | 0% |
| 3 | 100 | 150 | 100% | 0% | 0% | 0% | 0% | 0% |
| 4 | 150 | 200 | 9% | 91% | 0% | 0% | 0% | 0% |
| 5 | 200 | 250 | 0% | 100% | 0% | 0% | 0% | 0% |
| 6 | 250 | 300 | 0% | 100% | 0% | 0% | 0% | 0% |
| 7 | 300 | 350 | 0% | 18% | 82% | 0% | 0% | 0% |
| 8 | 350 | 400 | 0% | 0% | 100% | 0% | 0% | 0% |
| 9 | 400 | 450 | 0% | 0% | 100% | 0% | 0% | 0% |
| 10 | 450 | 500 | 0% | 0% | 27% | 73% | 0% | 0% |
| 11 | 500 | 550 | 0% | 0% | 0% | 100% | 0% | 0% |
| 12 | 550 | 600 | 0% | 0% | 0% | 100% | 0% | 0% |
| 13 | 600 | 650 | 0% | 0% | 0% | 36% | 64% | 0% |

TABLE 1-continued

STEAM SPLITTER ACCOUNTABILITY

| Block | LBound (m) | Ubound (m) | 1<br>Position (m) 77.27<br>Lbound (m) 0<br>Ubound (m) 154.55<br>S1 Acc. | 2<br>231.82<br>154.55<br>309.09<br>S2 Acc. | 3<br>386.36<br>309.09<br>463.64<br>S3 Acc. | 4<br>540.91<br>463.64<br>618.18<br>S4 Acc. | 5<br>695.45<br>618.18<br>772.73<br>S5 Acc. | Toe<br>850.00<br>772.73<br>850.00<br>Toe Acc. |
|---|---|---|---|---|---|---|---|---|
| 14 | 650 | 700 | 0% | 0% | 0% | 0% | 100% | 0% |
| 15 | 700 | 750 | 0% | 0% | 0% | 0% | 100% | 0% |
| 16 | 750 | 800 | 0% | 0% | 0% | 0% | 45% | 55% |
| 17 | 800 | 850 | 0% | 0% | 0% | 0% | 0% | 100% |

In this example, 5 steam splitters are utilized along the injection well and the 5 steam splitters along with the toe of the injection well are accountable for providing steam to each of the sections, referred to as blocks in Table 1. As shown in Table 1, one or a maximum of two of the steam splitters and toe are accountable for providing steam to any one section or block. For example, the first steam splitter, noted as S1 is accountable for 100% of the steam delivered to each of the first three sections or blocks. Two steam splitters are accountable for the steam delivered to the fourth block, however. As illustrated, the first steam splitter is accountable for 9% of the steam delivered to the fourth block while the second steam splitter is accountable for 91% of the steam delivered to the fourth block.

Utilizing the accountability, the relative steam flow from each of the steam splitters is determined by summing, for each section or block, the product of steam accountability for that steam splitter multiplied by the total producible oil in place in that section or block.

The total number of steam outlets for each steam splitter is determined utilizing hydraulic pipe flow calculations and based on the relative steam flow determined.

FIG. 8 through FIG. 11 are graphs illustrating the effect of utilization of the method of FIG. 5 on cumulative oil produced, cumulative steam to oil ratio, and oil production rate. These graphs illustrate the modeled results of production in which the present method is not utilized and results of production in which the present method is utilized. The lighter line in the graphs represents the results when the steam injection is customized by determining the number of steam outlets for each steam splitter based on geological properties of the reservoir in accordance with the present method. The black line represents the results when steam injection is not customized. The results are obtained by modelling a reservoir utilizing modelling software to compare recovery of hydrocarbons (referred to as oil) utilizing the present method to the recovery of hydrocarbons without utilizing the present method.

Figure 8:
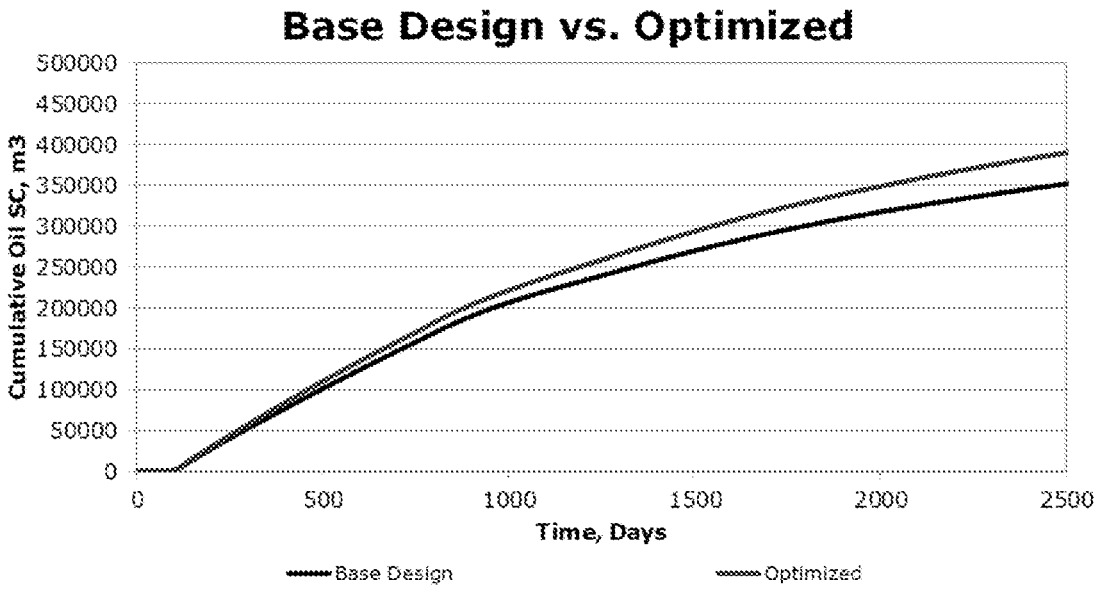
FIG. 8 through FIG. 11 are graphs illustrating the effect of utilization of the method of FIG. 5 on cumulative oil produced, cumulative steam to oil ratio, and oil production rate.
Figure 9:
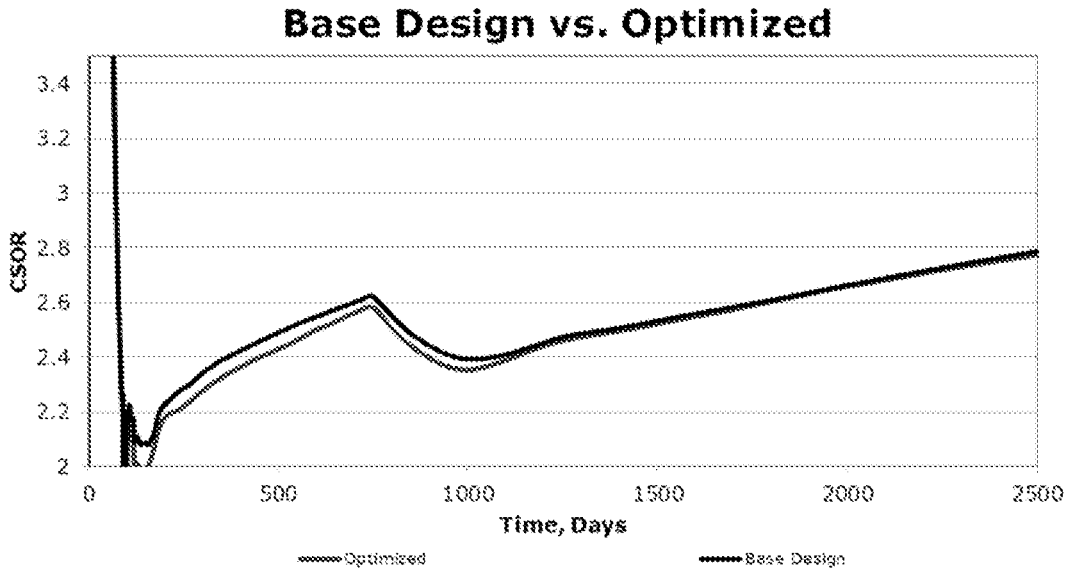
Figure 10:
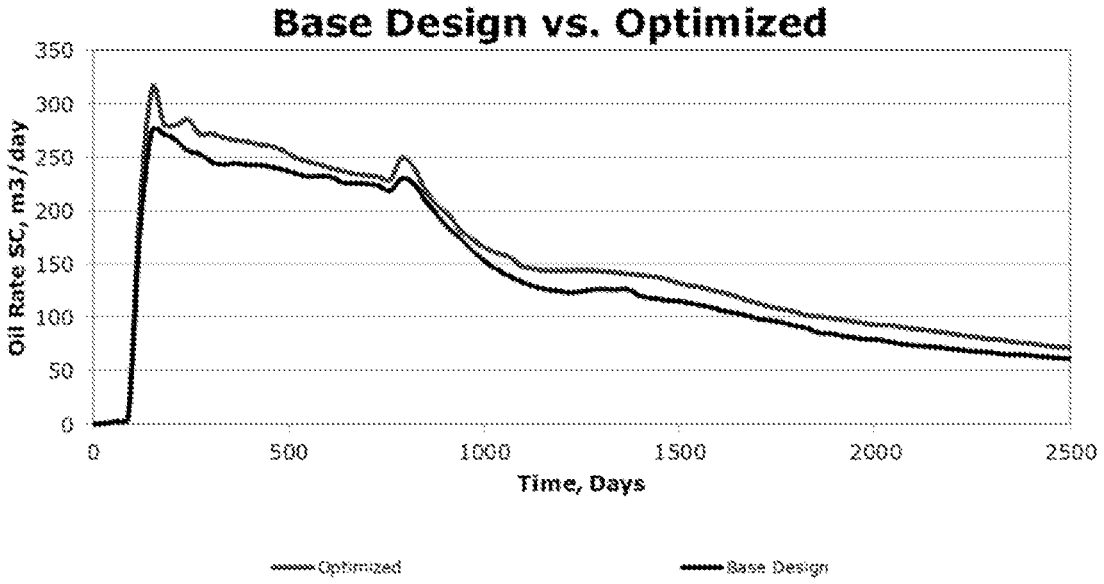
Figure 11:
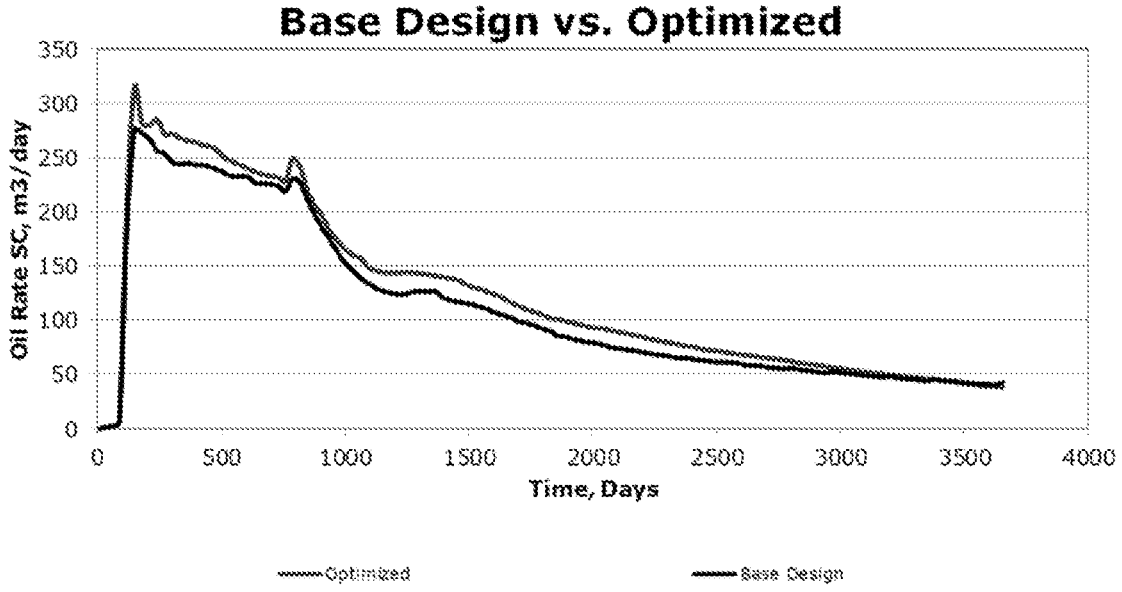

FIG. 8 is a graph showing the cumulative oil produced over time and illustrates that a greater volume of oil is produced utilizing the present method. FIG. 9 is a graph showing the cumulative steam to oil ratio (CSOR) over time and shows a slight improvement in CSOR utilizing the present method. FIG. 10 a graph showing oil production rate over time, illustrating improved oil recovery rate utilizing the present method. FIG. 11 is a graph showing oil production rate over a greater period of time.

Advantageously, the injection well is customized by customizing the steam injection based on reservoir geology. Thus, steam injection is customized to facilitate recovery of hydrocarbons based on geological properties of the reservoir along the length injection. Thus, recovery of hydrocarbons is improved by customizing the steam injection to account for reservoir heterogeneity.

In the above description, the steam splitters 314 are described with reference to FIG. 4A and FIG. 4B. Alternatively, the steam splitters 314 may be shiftable steam splitters to control the flow of steam through each steam splitter and into the reservoir. Each steam splitter includes a body that has borehole through the body and through which the steam flows. A plurality of steam outlets extend through the body. Each steam splitter includes a sleeve located within the borehole and including slots extending through the sidewall of the sleeve. The sleeve is shiftable from a closed position to an open position and from the open position to the closed position. In the closed position, the steam outlets through the body are out of alignment with the slots in the sleeve, inhibiting the flow of steam from the body into the reservoir. Seals located between the sleeve and the body are utilized to inhibit steam from escaping into the reservoir when the sleeve is in the closed position. In the open position, the steam outlets through the body are aligned with slots in the sleeve to facilitate the flow of steam from the borehole, through the slots, through the steam outlets, through the liner of the injection well, and into the reservoir.

Figure 12:
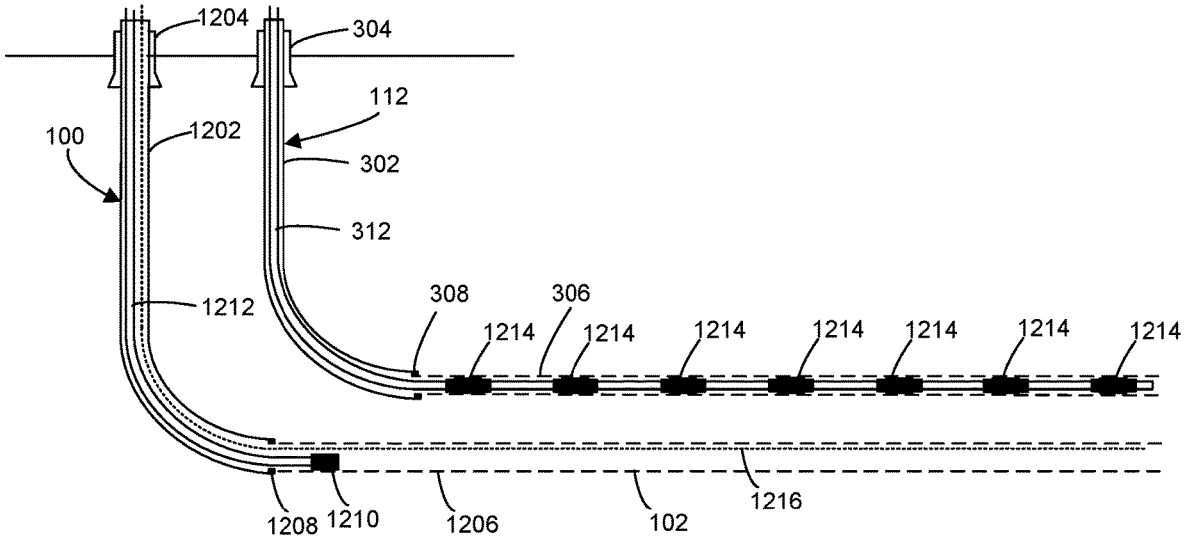
FIG. 12 is a side view of an injection well and a production well.

A sectional side view of an injection well 112 and a production well 100 is shown in FIG. 12. The injection well 112 may be similar to the injection well shown in FIG. 3 and described above. The injection well 112 includes the shiftable steam splitters 1214. The injection well 112 includes a casing 302 that extends generally vertically along the injection well 112, through a surface casing 304 to a liner 306, which may be a screen or slotted liner, for example. The casing 302 is coupled to the liner 306 utilizing a liner hanger 308.

Injection tubing 312 is coupled to steam facilities at the surface, such as a Once Through Steam Generator (OTSG) and extends through the wellbore of the injection well 112 to steam outlets of flow control devices, which in this example are shiftable steam splitters 1214. The shiftable steam splitters 1214 are spaced apart along the generally horizontal portion of the injection well, such that the shiftable steam splitters 1214 are located at generally regular intervals along the horizontal portion of the injection well 112. Alternatively, the shiftable steam splitters 1214 may be located at irregular intervals.

Figure 13:
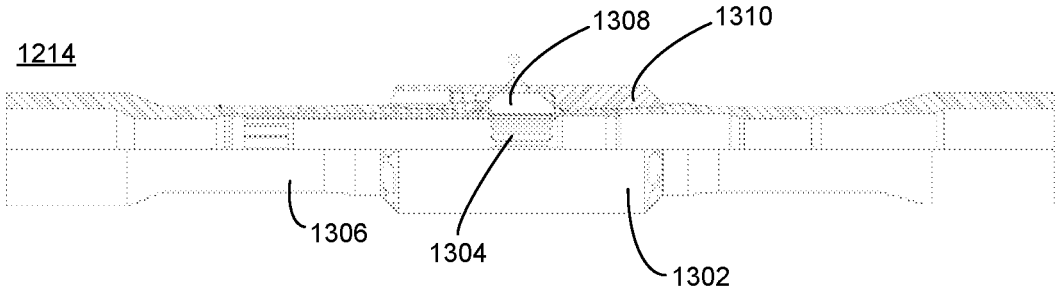
FIG. 13 shows a shiftable steam splitter with a sleeve in an open position.
Figure 14:
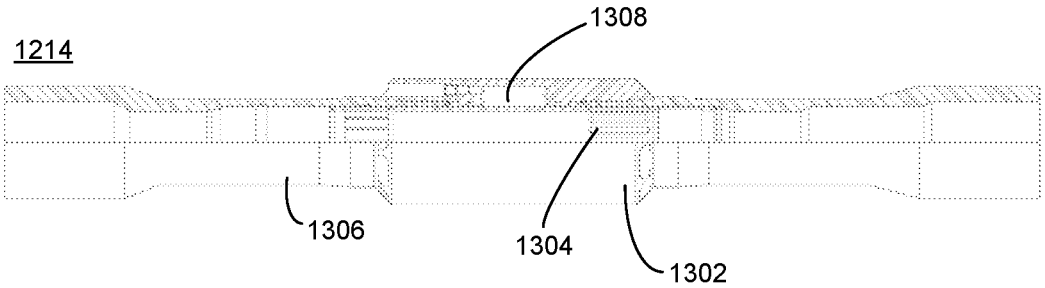
FIG. 14 shows a shiftable steam splitter with a sleeve in a closed position.

The shiftable steam splitters 1214 are utilized to control the flow of steam through each steam splitter 1214 and into the reservoir. Each shiftable steam splitter 1214 includes a sleeve 1302 that is shiftable, or moveable, from an open position as shown in FIG. 13 to a closed position as shown in FIG. 14. and from the closed position to the open position. In the closed position, the steam outlets 1304 through the body 1306 are out of alignment with slots 1308 in the sleeve 1302, inhibiting the flow of steam from the body 1306 into the reservoir. In the open position, the steam outlets 1304 through the body are aligned with slots 1308 in the sleeve to facilitate the flow of steam from the body 1306, through the steam outlets 1304, through the slots 1308, through the liner of the injection well, and into the reservoir.

Referring again to FIG. 12, the production well 100 includes a casing 1202 that extends generally vertically along the production well 100, through a surface casing 1204 to a liner 1206, which may be a screen or slotted liner, for example. The casing 1202 is coupled to the liner 1206 utilizing a liner hanger 1208.

The production well 100 optionally includes artificial lift such as a pump 1210, for example, an electric submersible pump for use in hydrocarbon recovery. The pump 1210 is disposed downhole in the production well 100 in or near the horizontal portion 102 into which fluid flows during the hydrocarbon recovery process. An outlet of the pump 1210 is coupled to a production tubing 1212 that extends inside the production well casing 1202, from a first end at the outlet of the pump 1210, to a second end at the surface.

A measurement system 1216 extends through the production well 100, through the casing 302 and along the liner 1206 for measuring temperature at various locations along the horizontal portion 102 of the production well 100. The measurement system 1216 may be a distributed temperature sensing (DTS) system for measurement of the temperatures as production fluids flow into the production well 100 and are produced to the surface.

Figure 15:
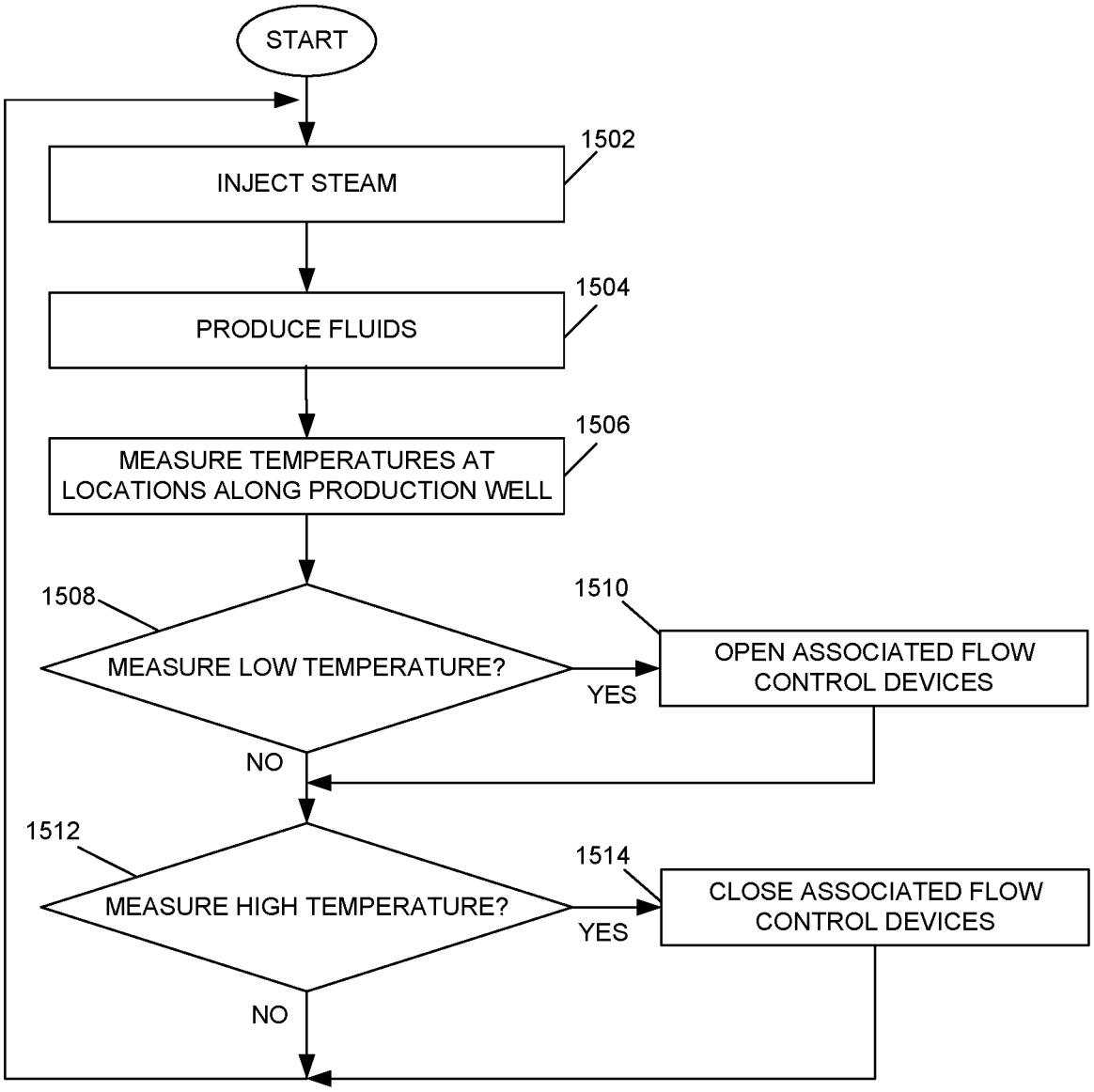
FIG. 15 is a flowchart showing a method of controlling steam injected via an injection well in a hydrocarbon recovery operation.

A flowchart illustrating a method of controlling steam injection via the injection well 112, such as the injection well shown in FIG. 12, is illustrated in FIG. 15. The method may include additional or fewer elements than shown and described and parts of the method may be performed in a different order than shown or described herein. The method may occur after startup of the well pair.

Steam is injected via the injection well 112 at 1502 into the hydrocarbon-bearing reservoir 106. Viscous hydrocarbons in the reservoir 106 are heated and mobilized and the mobilized hydrocarbons drain under the effect of gravity. The steam forms a steam chamber around and above the generally horizontal portion 114 of the injection well 112 in the reservoir 106. The steam may, optionally, also include solvent in a solvent aided process (SAP), for example.

Fluids are produced at 1504. The produced fluids include mobilized hydrocarbons as well as condensate, such as water from the steam, and connate water, in an emulsion. The injection of steam at 1502 and the production of fluids at 1504 are part of a SAGD or a SAP process in which the steam chamber is developed within the hydrocarbon-bearing reservoir.

The temperatures at locations along the production well 100 are measured utilizing the measurement system 1216, which may be a DTS as described with reference to FIG. 12. In response to detecting a low temperature at a location or a length along the measurement system 1216 at 1508, the process continues at 1510. It is desirable to achieve a generally consistent temperature across the measurement system 1216. The low temperature is considered low relative to a saturated steam temperature. A temperature may be considered low when the measured temperature is lower than an average temperature along the measurement system 1216. In another example, a low temperature may be a set temperature, such as 100° C. or lower. Associated flow control devices, which in the example of FIG. 12 are shiftable steam splitters 1214 are opened at 1510. Thus, in response to detecting that the temperature at a location along the measurement system 1216 disposed in the production well 100 is low, the nearest steam splitter 1214 or steam splitters 1214 in the injection well 112 are shifted to the open position to facilitate the injection of steam into the reservoir, to increase the temperature in a region of the reservoir associated with the location at which the low temperature is measured.

In response to detecting a high temperature at a location or a length along the measurement system 1216 at 1512, the process continues at 1514. A high temperature may be at or near the saturated steam temperature. Associated flow control devices, which in the example of FIG. 12 are shiftable steam splitters 1214 are closed at 1514. Thus, in response to detecting that the temperature at a location along the measurement system 1216 disposed in the production well 100 is high, the nearest steam splitter 1214 or steam splitters 1214 in the injection well 112 are shifted to the closed position to reduce the injection of steam and thereby reduce the temperature in a region of the reservoir 106 associated with the location at which the high temperature is measured.

Each of the shiftable steam splitters 1214 is separately controllable to facilitate opening of steam splitters 1214 and closing of steam splitters 1214 for selectively injecting steam into portions of the reservoir, thus affecting the temperature of the produced fluids at locations along the production well 100. Thus, one or more shiftable steam splitters 1214 may be opened with one or more other steam splitters 1214 closed while steam is injected into the reservoir 106 and while fluids are produced via the production well.

The method continues as steam is injected at 1502, fluids are produced at 1504, and the temperatures along the horizontal portion 102 of the production well 100 are measured at 1506.

The methods described herein are described with reference to the examples shown in FIG. 1, FIG. 2, and FIG. 12. Optionally, other wells may be utilized. For example, the system may include more production wells than injection wells or may include more injection wells than production wells. In addition, the injection wells may extend along a path that is laterally spaced from any production well, for example, and thus is not located directly above. Optionally, the injection and production well may be spaced laterally and generally at a same depth in the reservoir.

Advantageously, steam injection is controlled based on the temperatures measured in fluids produced along the length of the production well, to facilitate or improve heating of the reservoir and reducing the chance of generating hot or cold spots in the reservoir.

The invention claimed is:

1. An injection well in a hydrocarbon reservoir comprising:

steam injection tubing having steam splitters spaced apart along the length of the tubing, each of the steam splitters having a plurality of steam outlets for directing steam into the hydrocarbon reservoir, wherein a number of the plurality of the steam outlets is selected for operation for each of the steam splitters, the number varying between the steam splitters, the number for each of the steam splitters being selected based on a target flow of steam and location of each of the steam splitters along the length of the hydrocarbon reservoir, wherein the target flow of steam is determined based on hydrocarbon reservoir properties in sections of the reservoir, the sections of the reservoir each associated with at least one of the steam splitters.

2. The injection well according to claim 1, wherein the sections of the reservoir comprise three-dimensional sections divided in regular intervals.

3. The injection well according to claim 2, wherein each three-dimensional section is associated with one or two steam splitters.

4. The injection well according to claim 3, wherein the hydrocarbon reservoir properties comprise a volume of recoverable oil in each of the three-dimensional sections.

5. The injection well according to claim 2, wherein the hydrocarbon reservoir properties comprise a permeability of each of the three-dimensional sections.

6. The injection well according to claim 2, wherein the steam splitters comprise shiftable steam splitters for controlling the flow of steam into each of the three-dimensional sections.

7. The injection well according to claim 2, wherein the plurality of steam splitters is configured with set orifice sizes that are selected based on steam conditions at each steam splitter.

8. The injection well according to claim 7, wherein the set orifice sizes are selected to deliver substantially equal mass flow of steam to the formation despite changing steam conditions along the length of the tubing.

* * * * *